United States Patent [19]

Hendrick

[11] 3,995,327

[45] Dec. 7, 1976

[54] WATER SAVING TOILET ARRANGEMENT

[76] Inventor: John Richard Hendrick, 3255 Chelsey St., Mohegan Lake, N.Y. 10547

[22] Filed: Feb. 11, 1975

[21] Appl. No.: 549,078

[52] U.S. Cl. ..... 4/10; 4/76; 4/79; 4/89

[51] Int. Cl.[2] ..... E03D 1/00; E03D 3/00; E03D 5/00

[58] Field of Search ..... 4/10, 76, 1, 115, 89, 4/90, 79; 210/104, 242, 259, 181, 152, 167, 177, 196, 206, 220, 260

[56] References Cited

UNITED STATES PATENTS

| | | | |
|---|---|---|---|
| 3,112,497 | 12/1963 | Call | 4/10 X |
| 3,183,525 | 5/1965 | O'Brien et al. | 4/1 |
| 3,318,449 | 5/1967 | Jannings et al. | 210/104 |
| 3,579,646 | 5/1971 | Lekberg | 4/10 |
| 3,587,116 | 6/1971 | Quase | 4/10 |
| 3,633,218 | 1/1972 | Lekberg | 4/10 |
| 3,780,383 | 12/1973 | Katona | 4/10 |
| 3,815,159 | 6/1974 | Delaney | 4/10 |
| 3,873,445 | 3/1975 | Bussard | 210/149 |

*Primary Examiner*—Henry K. Artis
*Attorney, Agent, or Firm*—Henry Steckler

[57] ABSTRACT

An improved toilet which is a combination of a self-flushing system and an Econo-system, wherein re-cycled water from wash basins, or drinking fountains are used to supplement use of fresh water for flushing; the toilet including a lever operated by the toilet seat to activate a self flush piston having a manually adjustable regulator thereabove, and the toilet including an inner and outer tank with float valve means to control the intake of fresh water in accordance to the quantity of re-cycled water stored in the system at time of a flushing action.

13 Claims, 8 Drawing Figures

10
11
12
13
14
15
16
17
18
19
20
21
30
31
73
111

74
75
73
76
77
71
72
44
57
52
59
56
40
45
46
61
51
54
55
60
53
50
63
64
62
82
58
22
65
66
67
68
69

74
77
72
59
67

WATER SAVING TOILET ARRANGEMENT

BACKGROUND OF THE INVENTION

This invention relates generally to toilets.

A principal object of the present invention is to provide an improved toilet which incorporates an econo-system to conserve the use of fresh water when toilet is flushed, and when is accomplished by utilizing water that is drained from drinking fountains, wash basins, and the like.

Another object is to provide an improved toilet that additionally incorporates a self flushing system which utilizes the pressure on the toilet seat and drinking water, while the econo system uses water pressure and re-cycled water.

Yet another object is to provide an econo self flush toilet wherein the design of the self flushing system permits easy access to all parts as the system can be readily and easily dismounted, and all parts can be replaced without use of any special tools.

Still another object is to provide an econo self flush toilet in which no overflow is possible because the toilet is always open and an inner tank has an overflow opening.

Still another object is to provide an econo self flush toilet wherein a regulator on the top of the self flushing system permits adjustment of flow pressure for drinking water coming into the system.

Still a further object is to provide an econo self flush toilet wherein the toilet seat is completely independent of either system, therefor can be freely pivoted upwardly for easy cleaning of the toilet or for other purposes.

Still a further object is to provide an econo self flush toilet wherein there is no water condensation problem upon the tank's outside surface because there is an inner tank that serves as an insulator for a main outer tank.

Still a further object is to provide an econo self flush toilet wherein the seat cover can be used as a conventional seat without setting off the flushing system.

Still a further object is to provide an econo self flush toilet which reveals a new trend in toilet design by placing a sink above the tank, thus permitting a saving of space, and wherein the sink may also rotate above the tank up to 180°, with certain adjustments.

Other objects are to provide an econo self flush toilet which is simple in design, inexpensive to manufacture, rugged in construction, easy to use and efficient in operation.

These and other objects will be readily evident upon a study of the following specification and the accompanying drawings wherein:

PREFERRED EMBODIMENT

Figure 1:
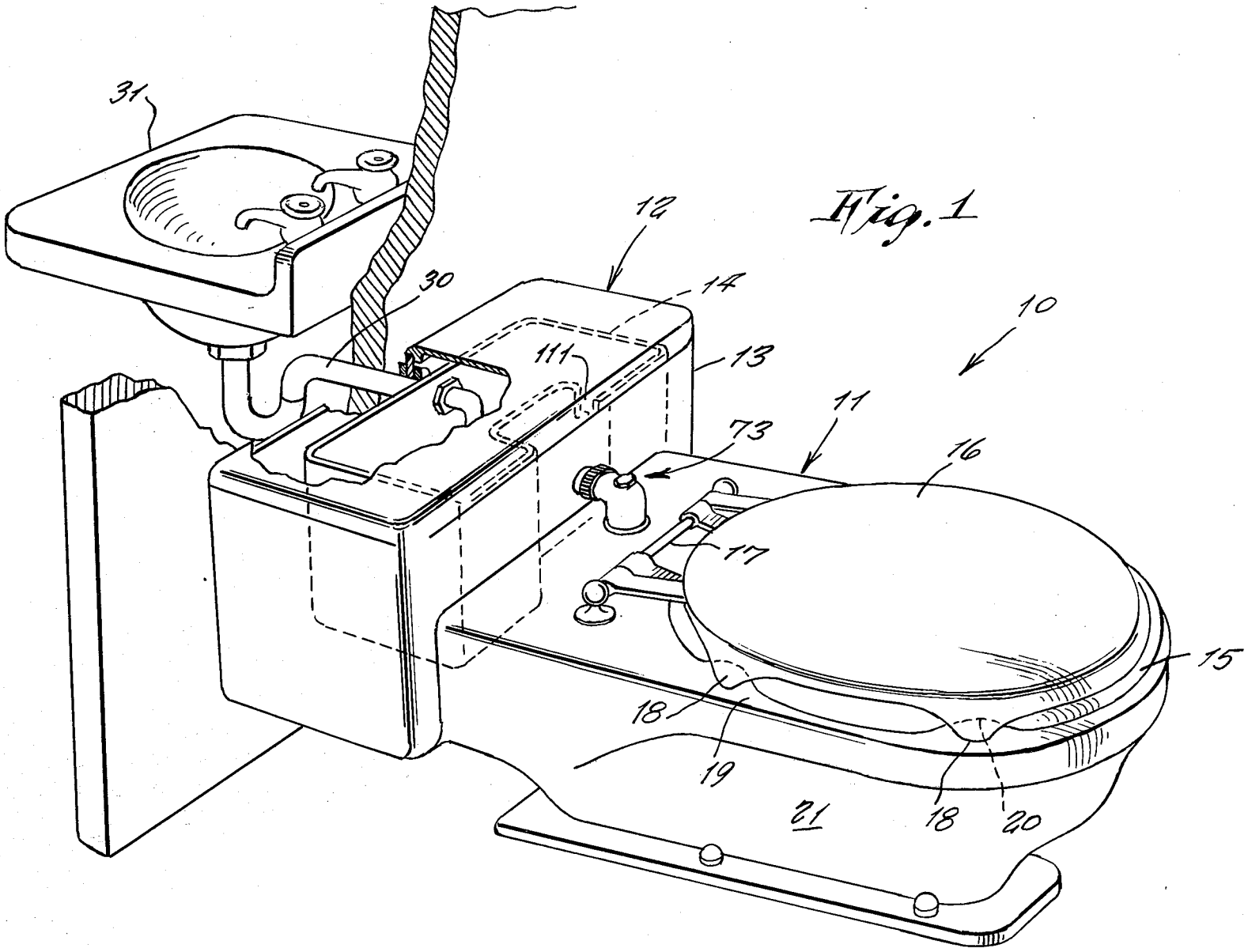
FIG. 1 is a perspective view of the present invention shown connected to a sink water supply.

Refering now to the drawings in detail, the reference numeral 10 in figure 1 represents an econo self flush toilet according to the present invention wherein there is a water closet or toilet unit 11 and a water supply tank assembly 12 consisting of an outer tank 13, containing an inner tank 14 for the purpose of storage of water which is to be flushed into the toilet unit 11.

The toilet unit 11 includes a toilet seat 15 and a cover 16; both of which are upwardly pivotable on a stationary bar 17. The cover 16 in order to serve as a seat cover includes feet 18 for resting directly upon the upper edge 19 of the toilet unit 11 instead of resting directly on top of the seat 15. Notches 20 in the seat 15 are provided to clear the feet 18 of the cover 16.

Figures 2, 3, 4:
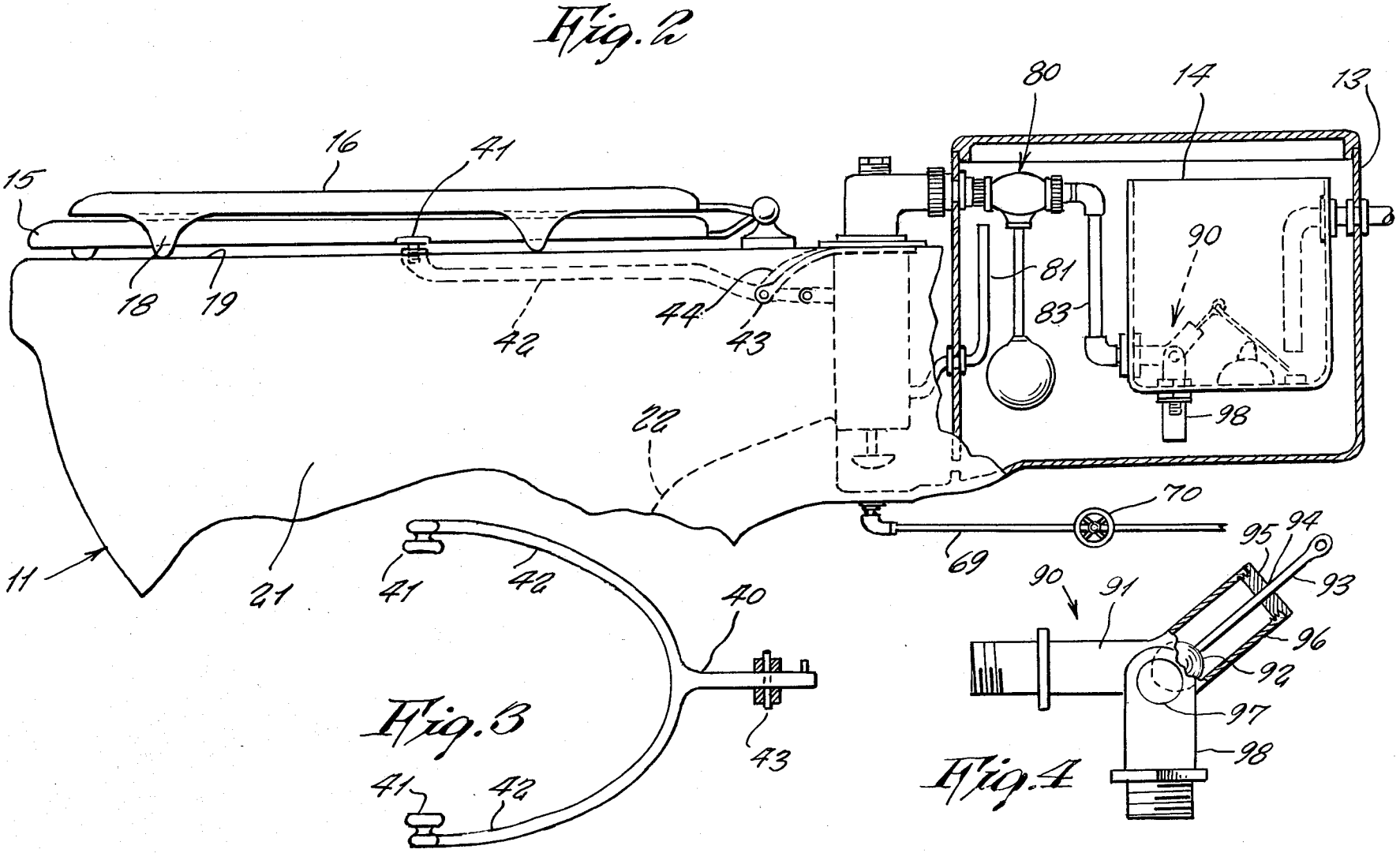
FIG. 2 is a fragmentary side view thereof shown partly in cross section.
FIG. 3 is a top view of a fork shaped lever shown in FIG. 2.
FIG. 4 is an enlarged detail of structure shown in FIG. 2 and located within the inner tank.

The toilet unit 11 includes ceramic bowl member 21 resting upon a floor and which may be integrally formed with the outer tank 13, as shown in FIG. 2.

In the present invention, a drain pipe 30 leading either from a wash basin 31 or from a drinking fountain, not shown, or from several of either or both extends through a rear side of the outer tank 13 and into the inner tank 14 where it is downwardly bent toward the tank bottom. If the inner tank 14 is full of water, then the additional water running through the drain pipe 30 to the econo self flush toilet would overflow through the overflow slot 111 into the regular outer tank 13 and run from there down into the toilet bowl 22 since the self flushing toilet system is open. Otherwise if the water level in the inner tank 14 is low, due to a recent flush, the water from the drain pipe 30 is collected in the inner tank 14.

The self flushing system incorporates a forked lever 40, shown in FIG. 3, contained within a hollow portion of the bowl member 21 and which includes a button 41 on each forked sprong 42 thereof; the buttons 41 protruding upwardly on the side of the rim of the upper edge 19 of bowl member 21 as to be positioned on an underside of the toilet seat 15 in order that they may be depressed thereby when the seat 15 is lowered to rest upon upper edge 19.

The lever 40 is pivotable about an axis pivot pin 43 supported in a stationary arm 44. The rear end of the lever 40 is connected pivotally free by a pin 45 to a plate 46 of the self flush unit 50, shown in FIG. 5, mounted within a rear portion of the bowl unit 21, thereby causing the plate 46 to be lifted when the buttons 41 are depressed downward by the seat 15. Depression of the buttons 41 to activate the plate 46 comprises the first cycle of operation of the invention.

The self flush unit 50, includes an outer cylinder 51 threadingly secured at 52 to the bowl member 21. An inner cylinder 53 is screwed within the outer cylinder 51. Openings 54 and 55 are provided respectively through a side of the cylinders 51 and 53 as to allow the plate 46, contained within the inner cylinder 53 to extend outwardly for connection with the lever 40.

A compression coil spring 56 bears pressure downwardly upon plate 46. The upper end of the spring 56 bears against stationary disc 57 contained in an upper end of the outer cylinder 51.

A self flush piston 58 extends vertically through a center of the cylinders 51 and 53, the plate 46 and coil springs, and consists of outer tubes 59 and 60 which threadingly are secured to the plate 46 in order that they also vertically move with the plate 46 inside the stationary cylinders 51 and 53. The inner cylinder 53 is shorter than the outer cylinder 51 and has a central chamber 61, while the outer cylinder 51 has a central chamber 62 located beneath the inner cylinder 53.

Figure 5:
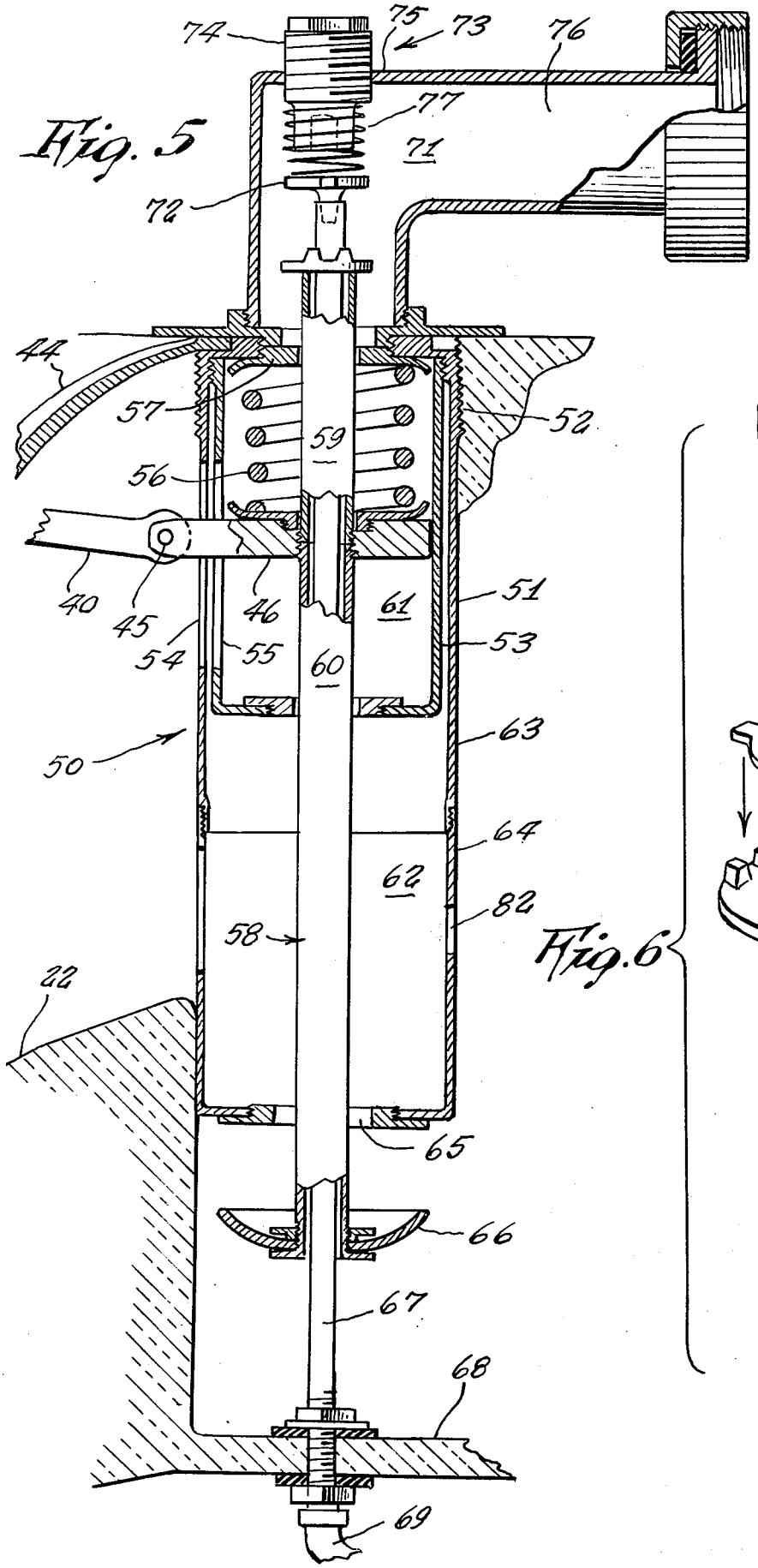
FIG. 5 is an enlarged scale cross sectional view of a self flush unit and a regulator.
Figure 6:
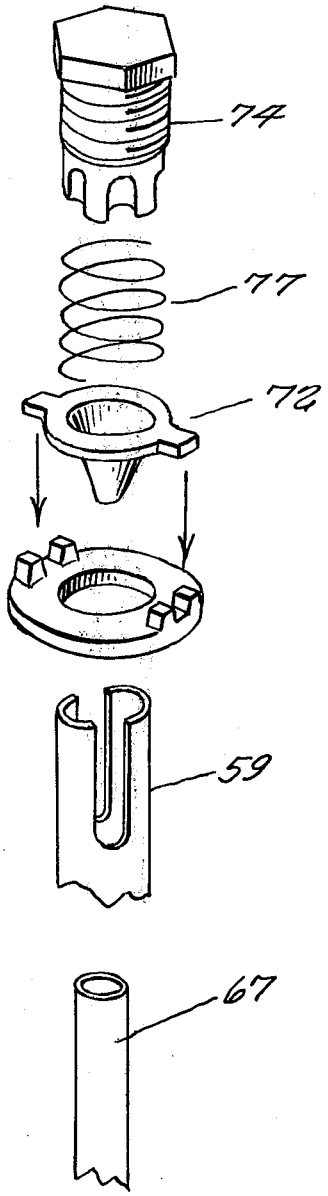
FIG. 6 is an exploded perspective view of the regular components.

As shown in FIG. 5, the outer cylinder 51 is comprised of separate components 63 and 64 screwed together. The lower end of the outer cylinder 51 has an outlet port 65 through which the outer tube 60 extends and which is closable by a clunch 66 secured on a lower end of the tube 60.

Within a center of the outer tubes 59 and 60, an inner tube 67 extends and which at its lower end is supported stationarily through a horizontal wall 68 of the bowl unit 21, and the lower end of the tube 67 thus extending externally of the bowl unit 21 and is connected to an incoming water line 69 fitted with manually controlled hand valve 70, as shown in FIG. 2.

The upper end of the inner tube 67 extends through the upper ends of the cylinders 51 and 53 into a regulator chamber 71 where it seats a valve 72 of a regulator 73. The regulator 73 is provided to allow manual adjustment of the flow pressure of incoming drinking water, and the regulator 73 includes a screw 74 threaded through a top wall 75 of a conduit 76, the lower end of the screw 74 bearing against the upper end of the compression coil spring 77 which at its lower end bears against the valve 72. These rotations of the screw 74 change pressure of the valve 72 against the seat.

The conduit 76 connects with the float valve unit 80, shown in FIG. 2 located inside the outer tank 13.

As shown in FIG. 2, an overflow pipe 81 extends from the outer tank 13 and connects with the chamber 62, shown on FIG. 5, of the outer cylinder 51 by means of the outer cylinder side opening 82.

A pipe 83, shown in FIG. 2 connected to the valve 80 extends into the interior of tank 14 where it connects to the econo system 90. The econo system 90, shown on FIG. 4, includes a three way pipe 91 containing a float ball 92 secured to a rod 93 which extends outward of the pipe through an opening 94 to an end cap 95 screwed on one arm 96 of the pipe 91. The float ball 92 controls opening and closing of an outlet port 97 at the junction of the pipe arms. Arm 98 is connected to the outer tank 13.

Figure 7:
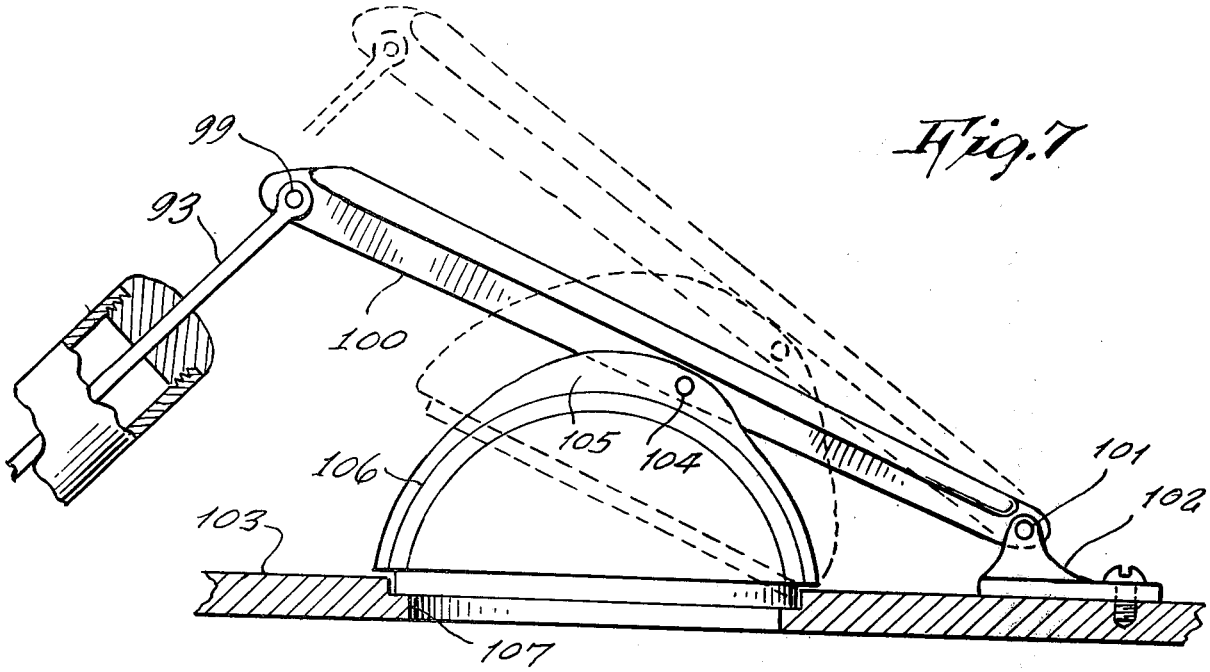
FIG. 7 is a side cross sectional view of the inner tank clunch unit.

The rod 93 is connected pivotally free by means of a pin 99 shown in FIG. 7 to one end of a lever 100 which at its other end is pivotable about a pin 101 supported in a stationary bracket 102 mounted upon the bottom wall 103 of the inner tank 14. A longitudinal mid-portion of the lever 100 is attached by a screw 104 to a lobe 105 of the clunch 106 fitted within an opening 107 in the bottom wall 103 of the inner tank 14.

Figure 8:
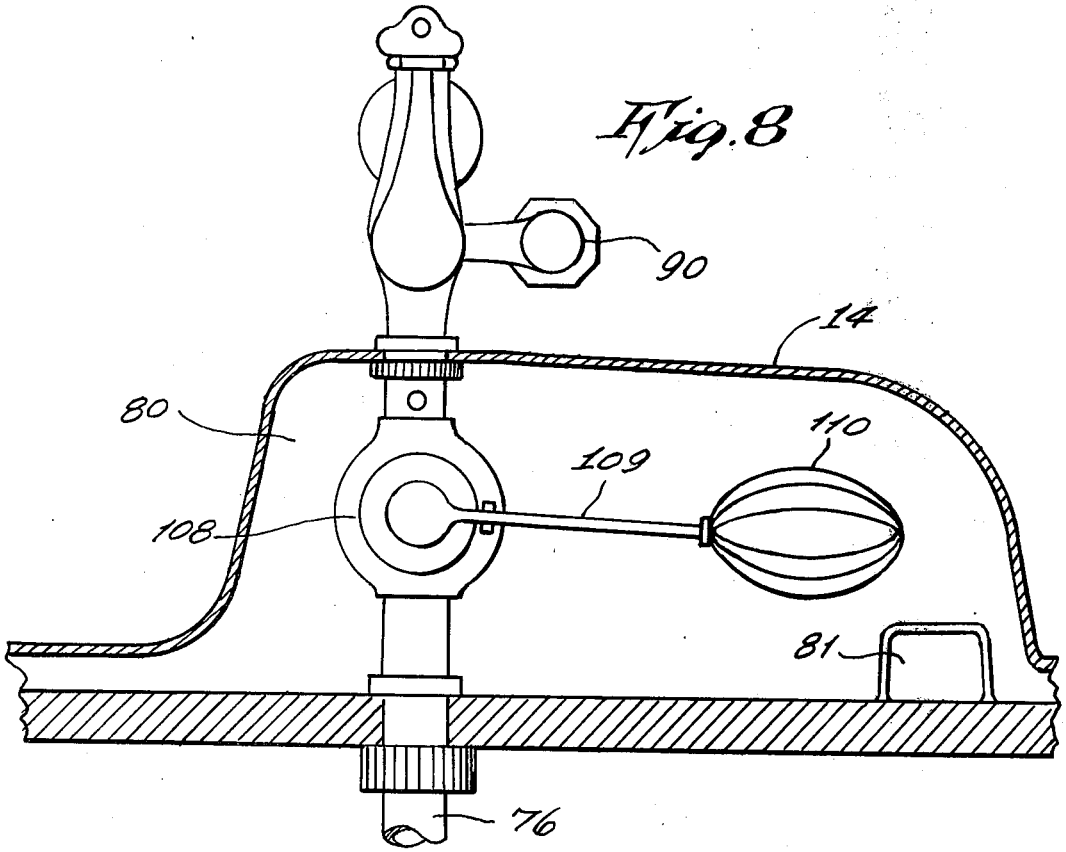
FIG. 8 is a cross sectional top view of the inner tank and the outer tank showing the float valve unit.

Reference is now made to FIG. 8 of the drawings which illustrates a construction wherein the float valve unit 80 is shown to include a valve 108 controlled by floater arm 109 attached to float 110 which responds to a water level rise within the outer tank 13 so thereby closing the valve 108 and therefore stopping the drinking water coming throughout conduit 76. This valve 108 prevents overflow in case the toilet seat 15 is depressed too long.

In the operation of the invention, depression of the seat 15 on the buttons 41 activates the plate 46 upwardly compressing the coil spring 77 and lifting vertically the outer tubes 59 and 60, therefore closing the clunch 66 and opening the valve 72 in the chamber 71.

Water released by the regulator valve 72 enters the float valve 80 in the outer tank 13 and then enters the inner tank 14 through the econo system 90.

Water under pressure pushes the float ball 92 upward and then flows into the regular outer tank 13. Since the float 92 in the econo valve 90 is pushed and kept in an upward position, it will lift the clunch 106 of the inner tank to permit re-cycled water to flow from the inner tank 14 to the outer tank 13.

The float 92 of the econo valve 90 will remain in an upward position as long as there is water in the valve. If the inner tank 14 is full or partly full of re-cycled water, the opening of the inner tank clunch would release this water into the outer tank 13 and level off. Thus drinking water and recycled water mixes. When the two tanks 13 and 14 are filled up, the floater 110 of the outer tank 13 will close the top valve 108 and stop the inflow of water.

The overflow pipe 81 will prevent any overflow of water if the floater 110 of the outer tank 13 fails to close the float valve 108, or any recycled water entering the tanks 13 and 14.

When the seat 15 is released, the buttons 41 under the seat 15 are restored to normal neutral position due to force of the spring 56. The spring 56 also pushes down the plate 46, thus pushing down the top tube 59, causing the regulator spring 77 to close the valve 72. Also the lower tube 60 opens the port 65 causing the toilet 22 to flush.

When the water level has decreased, no water remains in the econo valve 90, which permits the float ball 92 to return to its normal position and the clunch 106 to close the inner tank 14. The pre-use cycle is then in effect.

Thus there is provided a novel econo self flush toilet.

I claim:

1. A toilet comprising a toilet bowl; a water supply tank assembly disposed on said bowl; self-flushing piston means disposed on said tank assembly for mixing fresh and recycled water, said self flushing means comprising a stationary outer cylinder, a stationary inner cylinder disposed within said outer cylinder, each of said cylinders having a port at its bottom end, upper and low outer tubes disposed in said inner cylinder, said lower outer tube projecting through said ports, the lower end of said lower outer tube having a clunch means for closing said outer cylinder port, and a vertically slidable plate means for securing said tubes together; a toilet seat disposed on said bowl; and a lever means coupled to said seat and said plate for actuating said piston means.

2. A toilet as claimed in claim 1, further comprising a compression coil spring disposed within and at an upper end of said inner cylinder which normally rests against said plate to keep said clunch away from said port thereby keeping it open.

3. A toilet as claimed in claim 2, further comprising a stationary inner tube extending vertically through a center of said outer tubes, a lower end of said inner tube being adapted to be connected to an incoming fresh water supply, an upper end of said inner tube comprising a valve seat.

4. A toilet as claimed in claim 3, further comprising a regulator located above said inner tube valve seat, said regulator comprising a manually adjustable screw, a compression spring disposed below said screw, and a valve seated on said inner tube seat beneath said spring.

5. A toilet as claimed in claim 4, wherein the upper end of said upper outer tube has a groove ring means to open said regulator valve seated on said inner tube seat and allowing drinking water to run into the regulator chamber.

6. A toilet as claimed in claim 5, wherein said tank assembly comprises an outer tank, an inner tank disposed in said outer tank, and a drain pipe means for supplying recycled water being connected to said inner tank.

7. A toilet as claimed in claim 6, wherein said outer tank comprises a float valve unit connected to said regulator, a three way pipe valve connected to said float valve unit located inside said inner tank, and a clunch seated over an opening in a bottom wall of said inner tank, said pipe valve comprising means for lifting said clunch and allowing water from said inner tank to drain into said outer tank.

8. A toilet as claimed in claim 7, wherein said outer tank has an overflow duct means connected to said outer cylinder of said self flushing piston for running said water into said bowl.

9. A toilet as claimed in claim 1, further comprising a seat cover disposed above said seat, said toilet seat and said seat cover being independently and pivotably mounted on said bowl, whereby said seat cover can be used as a conventional seat without depressing said lever under said toilet seat.

10. A toilet as claimed in claim 6, wherein said inner tank comprises an insulator for said outer tank, thereby eliminating all condensation.

11. A toilet as claimed in claim 1, wherein said self flushing piston and said tank assembly permit placement of a rotable sink above said tanks, thereby permitting saving of space.

12. A toilet as claimed in claim 1, wherein said self flushing piston is a dismountable unit, thereby being replaceable without moving or dismounting said toilet bowl.

13. A toilet as claimed in claim 7, wherein said pipe valve and said inner tank are removable leaving said self flushing piston and said toilet bowl independently functional.

* * * * *